US006859970B2

(12) United States Patent
Roney et al.

(10) Patent No.: US 6,859,970 B2
(45) Date of Patent: Mar. 1, 2005

(54) AGITATOR FOR VACUUM CLEANER/ EXTRACTOR

(75) Inventors: Jeffrey T. Roney, Stanford, KY (US); Eric E. Muhlenkamp, Danville, KY (US)

(73) Assignee: Matsushita Electric Corporation of America, Secaucus, NJ (US)

( * ) Notice: Subject to any disclaimer, the term of this patent is extended or adjusted under 35 U.S.C. 154(b) by 226 days.

(21) Appl. No.: 10/198,557

(22) Filed: Jul. 18, 2002

(65) Prior Publication Data

US 2004/0010875 A1 Jan. 22, 2004

(51) Int. Cl.[7] ..... A47L 5/26; A47L 5/30

(52) U.S. Cl. ..... 15/141.2; 15/383; 15/179; 15/391; 15/392

(58) Field of Search ..... 15/389, 391, 392, 15/141.1, 141.2, 383, 179, 182; 492/47

(56) References Cited

U.S. PATENT DOCUMENTS

| | | | | | |
|---|---|---|---|---|---|
| 2,372,404 | A | * | 3/1945 | Taylor | 15/179 |
| 2,395,430 | A | | 2/1946 | Sloan | |
| 2,459,007 | A | | 1/1949 | Taylor | |
| 3,564,637 | A | | 2/1971 | Gollish | |
| 3,737,937 | A | | 6/1973 | Nordeen | |
| 4,173,807 | A | * | 11/1979 | Maier | 15/179 |
| 4,372,004 | A | | 2/1983 | Vermillion | |
| 4,648,150 | A | | 3/1987 | Morishita et al. | |
| 4,977,640 | A | | 12/1990 | Hirano et al. | |
| 5,115,538 | A | | 5/1992 | Cochran et al. | |
| 5,165,140 | A | | 11/1992 | Ide | |
| 5,249,328 | A | | 10/1993 | Shin | |
| 5,272,785 | A | | 12/1993 | Stegens | |
| 5,435,038 | A | | 7/1995 | Sauers | |
| 5,452,490 | A | | 9/1995 | Brundula et al. | |
| 6,085,383 | A | | 7/2000 | Wulff et al. | |
| 2003/0066150 | A1 | * | 4/2003 | Stegens et al. | 15/179 |
| 2003/0159240 | A1 | * | 8/2003 | Mertes et al. | 15/392 |
| 2004/0019992 | A1 | * | 2/2004 | Roney et al. | 15/179 |

* cited by examiner

*Primary Examiner*—Robert J. Warden, Sr.
*Assistant Examiner*—Laura C Cole
(74) *Attorney, Agent, or Firm*—King & Schickli, PLLC

(57) ABSTRACT

An agitator includes an axle, a pulley having a hub mounted to the axle and a belt receiving face having at least one lengthwise channel and a sleeve of molded material received over the axle and in the at least one lengthwise channel. A method of constructing an agitator from an axle and pulley includes the fitting of the axle into the pulley, the injecting of plastic resin into one end of the agitator forming mold on a first side of the pulley and the directing of plastic through at least one channel in the pulley to a second side of the pulley.

16 Claims, 2 Drawing Sheets

AGITATOR FOR VACUUM CLEANER/ EXTRACTOR

TECHNICAL FIELD

This invention relates generally to vacuum cleaners, extractors and other floor care equipment and, more particularly, to an agitator for use in such floor care equipment.

BACKGROUND OF THE INVENTION

Upright vacuum cleaners, extractors and canister vacuum cleaners with power nozzles incorporating rotary agitators are presently manufactured and marketed by a number of different companies. The agitators carry cleaning structures such as rubber wipers, beater bars, brushes, and tufted bristles to brush or beat dirt and debris from an underlying surface such as a carpet being cleaned.

The rotary agitators are rotated quickly at speeds up to 2500–6500 rpm and through engagement with the underlying carpet, are subjected to significant sheer forces. As such, the agitators must have relatively high inherent strength and fatigue resistance to withstand operation over an extended service life.

The present invention relates to a relatively low profile agitator constructed to have the necessary strength and fatigue resistance to reliably and dependably function over a long service life. Such a low profile agitator may, advantageously, be incorporated into a low profile nozzle assembly of an upright vacuum cleaner, power head or extractor which is capable of cleaning under overlying obstacles such as the projecting margin of built-in bathroom and kitchen cabinets or furniture such as beds, dressers and the like.

SUMMARY OF THE INVENTION

In accordance with the purposes of the present invention as described herein, an improved agitator is provided for use in floor care equipment. The agitator includes a high strength axle, a pulley including a hub mounted to the axle and a belt receiving face having at least one lengthwise channel, and a sleeve of molded material received over the axle and in the lengthwise channel. The axle and pulley may both be made of high strength metal while the molded material is preferably a plastic such as polyethylene although other plastics with or without fiber reinforcement may be utilized.

The sleeve carries a cleaning structure which may, for example, be selected from a group consisting of a beater bar, a brush, tufted bristles, a wiper and combinations thereof. The sleeve may be cylindrical in shape and have a diameter of no greater than 22.00 mm. The axle may have a diameter between about 4.00 mm to about 8.00 mm. In this way the axle acts as a high strength backbone for the sleeve while the sleeve has the necessary thickness to receive and securely hold the cleaning structures. Advantageously, the total construction has a low profile thereby allowing installation in even the most low profile nozzle assemblies, power heads or extractors.

In accordance with the more specific aspect of the present invention, the pulley includes an end flange and two opposed lengthwise channels passing through the end flange. As will be described in greater detail below, the channels provide a pathway across the pulley through which the plastic may travel during the molding process prior to setting so that the plastic need only be injected into the mold through one end.

In addition to the hub for securing to the axle, the pulley may also include a metal D-nut for engaging a stub shaft of a drive gear typically carried on the nozzle assembly, power head or housing of the vacuum cleaner or extractor to which the agitator is mounted.

In accordance with yet another aspect of the present invention, a method for constructing an agitator from an axle and a pulley is provided. The method includes the steps of fitting the axle into the pulley, injecting plastic resin into one end of the mold on a first side of the pulley and directing plastic through at least one channel on the pulley to a second side of the pulley. The method further includes the cooling of the plastic resin to a setting temperature and the removing of the agitator from the mold.

In the following description there is shown and described one embodiment of the invention, simply by way of illustration of one of the modes best suited to carry out the invention. As it will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention, and together with the description serves to explain the principles of the invention. In the drawing.

Figures 1, 2:
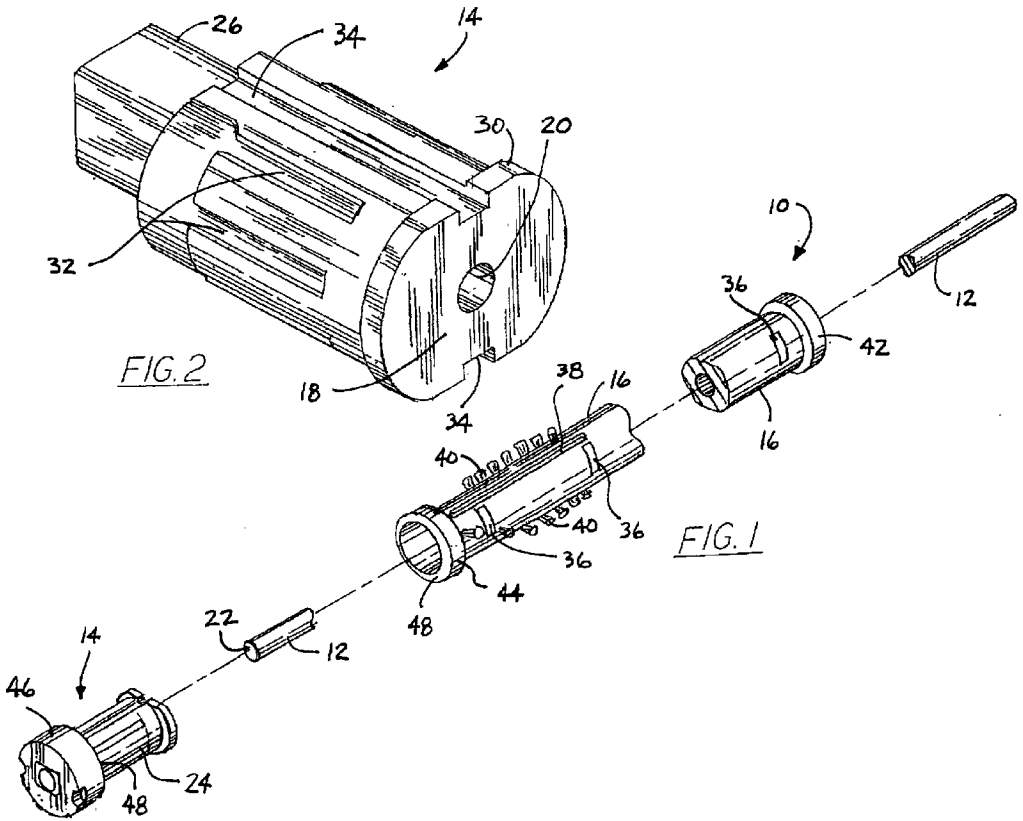
FIG. 1 is an exploded perspective view of the agitator of the present invention.
FIG. 2 is a detailed perspective view of the pulley.
Figure 4:
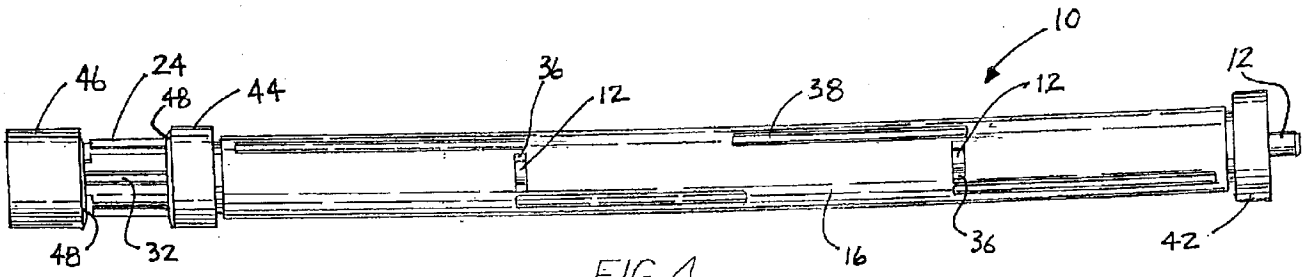
FIG. 4 is a side elevation view of the agitator.
Figure 3:
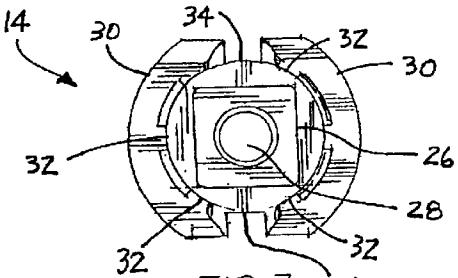
FIG. 3 is a detailed elevational view of the pulley from the D-nut end thereof.
Figure 5:
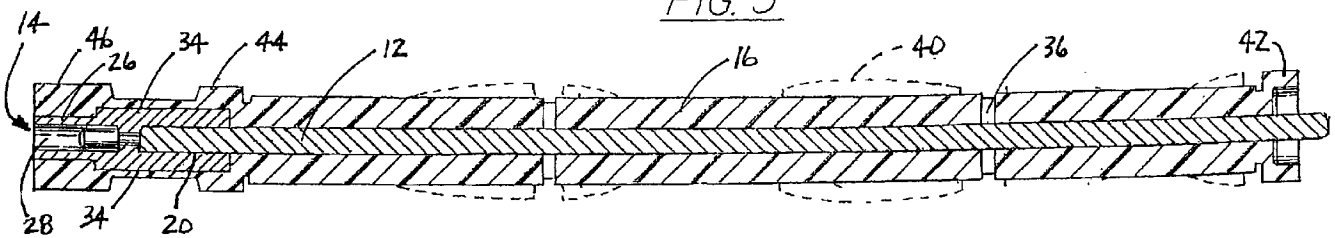
FIG. 5 is a cross sectional view of the agitator taken through the two opposed plastic receiving channels of the pulley.

Reference will now be made in detail to the embodiment of the invention illustrated in the accompanying drawing figures.

DETAILED DESCRIPTION OF THE INVENTION

Reference is now made to the drawing figures which clearly illustrate the belt-driven agitator 10 of the present invention. The agitator 10 generally comprises three component parts, the axle 12, the pulley 14 and the molded plastic sleeve 16.

The axle 12 is a single continuous shaft of high strength metal and may have a diameter between about 4.00 to about 8.00 mm. The pulley 14 includes a hub 18 having an aperture 20 to receive a first end 22 of the axle 12 and a belt receiving face 24. In applications incorporating multiple agitator cleaning systems, the pulley 14 may also include an optional D-nut end 26 including a socket 28 sized and shaped to receive a stub shaft (not shown) of an appropriate drive gear which is held for relative rotation on the floor care equipment to which the agitator is mounted. That drive gear is connected to a drive box that includes one or more additional gears for driving one or more additional agitators as, for example, described in PCT patent application Ser. No. PCT/US02/08340, filed Mar. 19, 2002, entitled "Agitator Drive System with Bare Floor Shifter", the full disclosure of which is incorporated herein by reference. The pulley 14 is preferably formed from a high strength material such as sintered powder metal. The pulley 14 includes an end flange 30 adjacent the belt receiving face 24.

The belt receiving face 24 may also include a series of spaced grooves 32 adapted to provide increased friction when engaging a drive belt. While grooves 32 are illustrated, it should, of course, be appreciated that substantially any other structure for increasing the frictional engagement of the belt receiving face 24 of the pulley with the drive belt may be incorporated in the pulley.

In accordance with yet another aspect of the present invention, at least one lengthwise channel 34 is provided extending across the entire belt receiving face 24 including the end flange 30. As illustrated in the drawing figures, two such channels 34 are provided in opposed positions about the circumference of the pulley 14. As will be described in greater detail below, these channels 34 provide passageways allowing the passage of plastic resin from one end of the pulley to the other end during the molding process. In this way plastic resin need only be injected into the mold from one end thereby simplifying mold design and substantially eliminating potential complications from the molding process. In addition, the channels 34 function to lock the pulley 14 and the D-nut end 26 against rotation in the sleeve 16.

The sleeve 16 is molded around the axle 12, in the channels 34 and over the end flange 30 and D-nut end 26 of the pulley 14, preferably formed from a molded plastic such as polypropylene/ABS or any other appropriate resinous material whether reinforced with fiber or not. This sleeve 16 may also include spaced through slots 36 and spaced, axially extending grooves 38. The slots 36 allow the axle 12 to be held in place in the mold during the sleeve molding process. The slots 36 and grooves 38 are also of sufficient size and depth to receive a scissor blade so that one may easily cut hair, string or other elongated material that might become entangled on and wrapped around the agitator 10 during use of the floor care equipment on which the agitator is operated. Thus, these slots 36 and grooves 38 greatly simplify the process of cleaning the agitator when that becomes necessary.

The sleeve 16 is generally cylindrical in overall shape and has a diameter of no greater than about 22 mm. As a result, the agitator 10 may be utilized in very low profile floor care equipment such as vacuum cleaners and extractors that provide the necessary clearance for cleaning under low overhangs such as furniture and kitchen and bathroom cabinet margins. The high strength metal axle 12 provides rigidity, strength and balance or TIR to the agitator 10 yet the relatively small diameter of the axle advantageously allows the agitator to be made with a small diameter or low overall profile as described.

As illustrated, the sleeve 16 includes two helical patterns of tufted bristles 40 which function as cleaning structures for brushing and beating the nap of a carpet as the agitator 10 is rotated at rpms up to 2500–6500 by the cleaning equipment to which it is operatively mounted. More particularly, a series of holes are drilled in the sleeve 16 and the tufted bristles 40 are secured in those holes with an appropriate adhesive or by mechanical fastening means such as staples. Of course, the agitator 10 may include tufted bristles presented in a different pattern or arrangement and/or other different cleaning structures such as a beater bar, a brush, a wiper or combinations thereof Thus, the illustrated embodiment is simply exemplary of any number of possible constructions and should not be considered limiting.

The agitator 10 of the present invention is relatively easy to manufacture. The first step in the manufacturing process is the fitting of the axle 12 into the hub 18 of the pulley 14. This subassembly is then placed in the mold and the mold is closed. This is followed by injecting plastic resin into one end of the closed mold on a first side of the pulley. That resin fills the space in the mold to form the enlarged rim 42 at the first end of the agitator 10, the sleeve 16 received over the axle 12 and the enlarged rim 44 received over the end flange 30 adjacent the belt receiving face 24. The plastic resin then passes through and fills the channels 34 extending lengthwise across the belt receiving face 24 of the pulley 14. The resin passing through the channels 34 then fills the space in the mold to form the outer rim 46 over the D-nut end 26 of the pulley 14. The rims 44 and 46 include opposed shoulders 48 that function to maintain a drive belt (not shown) aligned in engagement with the belt receiving face 24 of the pulley 14.

While the molding process just described relates to injecting plastic resin into the mold at the end furthest from the pulley 14, it should be appreciated that the plastic may be injected into the mold at the end closest to the pulley. In either approach the method includes the step of directing the plastic through the at least one channel 34 in the pulley to the second side of the pulley. Of course, while two channels 34 are illustrated it should be appreciated that substantially any number of channels may be provided.

This is then followed by the cooling of the plastic resin to a setting temperature and the removing of the agitator 10 from the mold. Following molding is the securing of cleaning structures such as tufted bristles 40 onto the sleeve 16. This may be accomplished by drilling an appropriate pattern of apertures in the sleeve 14 and then utilizing a friction fit and an adhesive or staples to secure the bristles 40 in those apertures. Alternatively, dovetail channels, grooves or other structures may be provided for receiving and holding a wiper, a brush, a beater bar or other appropriate structures. Of course, such structures may also be molded integrally with the sleeve 16 when the sleeve is molded onto the axle 12 if desired.

In summary, numerous benefits result from employing the concepts of the present invention. The agitator 10 is made from inexpensive materials by means of a relatively simple and inexpensive manufacturing process. The metal belt receiving face 24 of the pulley 14 provides a durable, high strength and long lasting component part capable of properly engaging a drive belt and providing optimal performance over a long service life. The lengthwise channels 34 formed in the pulley 14 allow passage of plastic resin from one side of the pulley to the other so that it is only necessary to inject plastic in one end of the mold during the agitator construction process. This simplifies the molding process and reduces the capital cost of the mold and molding equipment.

The agitator 10 also includes a high strength metal axle 12 which forms a rigid spine over which relatively inexpensive plastic materials may be molded to provide a sleeve 16 for receiving and holding the selected cleaning structure. The agitator 10 may be produced with a relatively low profile for receipt and use in low profile cleaning equipment better capable of reaching under obstructions commonly found in residential and commercial structures. Advantageously, the low profile of the agitator 10 is achieved without compromising strength so that the agitator will function dependably and reliably over a long service life.

The foregoing description of the preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. An agitator comprising:

an axle;

a pulley including (a) a hub mounted to said axle and (b) a belt receiving face having at least one lengthwise channel; and a sleeve of molded material received over said axle and in said at least one lengthwise channel.

2. The agitator of claim 1 wherein said sleeve carries a cleaning structure.

3. The agitator of claim 2, wherein said cleaning structure is selected from a group consisting of a beater bar, a brush, tufted bristles, a wiper and combinations thereof.

4. The agitator of claim 1, wherein said sleeve is generally cylindrical in shape having a diameter of no greater than 22.00 mm.

5. The agitator of claim 4, wherein said axle has a diameter between about 4.00 mm to about 8.00 mm.

6. The agitator of claim 1, wherein said pulley includes an end flange and two opposed lengthwise channels passing through said end flange.

7. The agitator of claim 1, wherein said pulley includes a metal D-nut.

8. The agitator of claim 1, wherein said sleeve further includes spaced slots and spaced axially extending grooves.

9. An agitator, comprising;

a continuous metal axle;

a metal pulley secured to a first end of said continuous metal axle, said pulley including a belt receiving face having at least one lengthwise channel; and a sleeve of molded plastic material received over said axle and in said at least one lengthwise channel.

10. The agitator of claim 9, wherein said sleeve carries a cleaning structure.

11. The agitator of claim 10, wherein said cleaning structure is selected from a group consisting of a beater bar, a brush, tufted bristles, a wiper and combinations thereof.

12. The agitator of claim 9, wherein said sleeve is generally cylindrical in shape having a diameter of no greater than 22.00 mm.

13. The agitator of claim 12, wherein said axle has a diameter between about 4.00 mm to about 8.00 mm.

14. The agitator of claim 9, wherein said pulley includes an end flange and two opposed lengthwise channels passing through said end flange.

15. The agitator of claim 9, wherein said pulley includes a metal D-nut.

16. The agitator of claim 9, wherein said sleeve further includes spaced slots and spaced axially extending grooves.

* * * * *